US006976684B2

(12) United States Patent
Carrasca

(10) Patent No.: US 6,976,684 B2
(45) Date of Patent: Dec. 20, 2005

(54) SNOWBOARD BINDING SYSTEM HAVING MULTIPLE TOOL-LESS ADJUSTMENTS

(75) Inventor: Robert G. Carrasca, Seattle, WA (US)

(73) Assignee: K-2 Corporation, Vashon, WA (US)

( * ) Notice: Subject to any disclaimer, the term of this patent is extended or adjusted under 35 U.S.C. 154(b) by 73 days.

(21) Appl. No.: 10/438,741

(22) Filed: May 14, 2003

(65) Prior Publication Data

US 2004/0227328 A1 Nov. 18, 2004

(51) Int. Cl.[7] ..... A63C 9/081
(52) U.S. Cl. ..... 280/14.22; 280/618
(58) Field of Search ..... 280/14.21, 14.22, 280/611, 617, 618

(56) References Cited

U.S. PATENT DOCUMENTS

| | | | | |
|---|---|---|---|---|
| 4,973,073 | A * | 11/1990 | Raines et al. | 280/624 |
| 5,035,443 | A * | 7/1991 | Kincheloe | 280/618 |
| 5,505,478 | A * | 4/1996 | Napoliello | 280/618 |
| 5,810,370 | A * | 9/1998 | Covert et al. | 280/14.24 |
| D409,703 | S | 5/1999 | Lee | |
| 5,975,557 | A * | 11/1999 | Snoke et al. | 280/624 |
| 6,196,559 | B1 | 3/2001 | Cress | |
| 6,283,482 | B1 * | 9/2001 | Coulter | 280/14.22 |
| 6,283,492 | B1 | 9/2001 | Hale | |
| 6,364,323 | B1 | 4/2002 | Coulter | |
| 6,390,492 | B1 | 5/2002 | Bumgarner et al. | |
| 6,406,040 | B1 | 6/2002 | Thorne | |
| 6,416,075 | B1 | 7/2002 | Laughlin et al. | |
| 2002/0008366 | A1 | 1/2002 | Rittmeyer | |
| 2002/0027335 | A1 | 3/2002 | Hale | |
| 2002/0062581 | A1 | 5/2002 | Couderc | |
| 2002/0163162 | A1 | 11/2002 | Haupt | |

FOREIGN PATENT DOCUMENTS

| | | |
|---|---|---|
| DE | 09113766 | 2/1992 |
| DE | 297 00 631 U1 | 6/1997 |
| EP | 0 692 285 B1 | 12/1994 |
| EP | 1 095 675 A1 | 5/2001 |
| EP | 0 741 530 B1 | 12/2001 |
| EP | 1 186 328 A2 | 3/2002 |
| FR | 2 755 030 A1 | 4/1998 |
| FR | 2 758 468 A1 | 7/1998 |
| WO | WO 01/49381 A1 | 7/2001 |

* cited by examiner

*Primary Examiner*—Christopher P. Ellis
*Assistant Examiner*—Brian Swenson
(74) *Attorney, Agent, or Firm*—Christensen O'Connor Johnson Kindness PLLC

(57) ABSTRACT

An adjustable binding system includes a frame and a highback pivotally coupled thereto. The highback includes a wing adjustably connected to a heel loop. The frame is adjustable via at least one length adjuster to provide adjustment of the toe to heel length of the frame so that the binding system can better accommodate varying sizes of boots. Additionally, the binding system is adjustable at the connection interface of the heel loop and the frame via forward lean adjusters to provide an adjustment of an angle of forward inclination between the highback and the frame. The binding system is further adjustable between the connection of the wing and the heel loop via a wing position adjuster to provide an adjustment of the height and medial to lateral positioning of the wing with respect to the heel loop. Each adjustment mechanism may be hand operated without the use of tools.

45 Claims, 12 Drawing Sheets

SNOWBOARD BINDING SYSTEM HAVING MULTIPLE TOOL-LESS ADJUSTMENTS

FIELD OF THE INVENTION

The present invention relates to binding systems for releasably securing a rider and a glide board, and more particularly to snowboard binding systems.

BACKGROUND OF THE INVENTION

The sport of snowboarding has been practiced for many years, and has grown in popularity in recent years, establishing itself as a popular winter activity rivaling downhill skiing. In snowboarding, a rider stands with both feet atop a single board, and negotiates a gravity-propelled path down a snow-covered slope. Both of the rider's feet are secured to the snowboard, and the rider controls speed and direction by shifting his or her weight and foot positions. Controlling the snowboard is accomplished by rotating the snowboard about its longitudinal axis, thereby selecting which edge of the snowboard engages the snow, the angle of engagement, and the orientation of the snowboard with respect to the slope of the terrain.

In order to control the orientation of the snowboard, the rider wears boots that are firmly secured to the snowboard by snowboard bindings and in an orientation that is generally transverse to the longitudinal axis of the snowboard. Many snowboard bindings have been developed, generally categorized as either strap bindings (also called conventional bindings), where a pair of frames having straps for releasably securing the rider's boots is attached to the board, or step-in bindings, where cleat mechanisms are integrated into the sole of the snowboard boots and a complementary cleat-engagement mechanism is attached to the snowboard.

In strap bindings, the binding frame typically includes a flat base portion that receives the sole of the boot. The base portion attaches to the board, frequently in an adjustable manner such that the rider can select a particular angle between the boot axis and the board axis. Integral side walls extend upwardly from either side of the base portion, providing lateral support to the attached boot, and a highback is pivotally connected the rear of the frame and extends vertically therefrom. Due to the pivotal connection, the highback can be set at a pre-selected forward lean angle. Typically, two pairs of straps are included and attached to the frame side walls, the straps being adapted to extend over the rider's boots and adjustably interconnect, to secure the snowboard boots to the snowboard. The first pair of straps extends generally around the ankle portion of the boot, and the second pair extends generally over the toe portion of the boot.

Board control may also be affected by the height, medial to lateral positioning, and the amount of forward lean, i.e., the angle of the rider's leg with respect to the horizontal plane, of the highback. For example, as the height of the highback increases, its force transmission increases resulting in more responsive board control. Conversely, as the height of the highback decreases, its power transmission decreases resulting in less responsive board control. Additionally, as the forward lean increases, the rider is able to more efficiently set the edges of the board on the snow, resulting in improved board control. Accordingly, as a rider becomes more skilled at snowboarding, it is often desired to be able to adjust the binding such that the forward lean is adjusted. Further, the rider may often wish to change the height or medial to lateral positioning of the highback such that different maneuvers are possible and to provide improved rider comfort and performance.

The optimal adjustments of the binding is a function of several factors, such as the snow conditions on the slopes, the terrain of a specific run, and the particular form and ability of the rider. Since snow conditions and terrain often change from one run on a hill to another, snowboarders often want to adjust their bindings. However, adjustments on prior art bindings, such as forward lean or medial to lateral adjustments of the highback, are difficult to make on the hill because the rider must use a screwdriver or other tools to manipulate the adjustment mechanisms so that the binding can be adjusted to meet the demands of the rider. It is inconvenient or impractical to carry a tool out on the slopes, and it is often difficult to handle a tool barehanded in cold, icy conditions. Most snowboarders, accordingly, do not adjust the binding as often as they would like, and thus, most snowboarders do not get the optimum performance from their boards.

SUMMARY OF THE INVENTION

The embodiments of the present invention provide a tool-less adjustable binding system. The binding system is formed with multiple manual, tool-less adjustment mechanisms. Each tool-less adjustment mechanism may be gripped by hand and operated without the use of tools to actuate the adjustment so that the rider can make adjustments to their boards easily and effectively either before the start of a run or on the slopes without removing their boots from the bindings.

In accordance with one aspect of the present invention, an adjustable binding system is provided that includes a base member adapted to be mounted to a surface traversing apparatus, such as a snowboard. The base member includes rail members disposed longitudinally along opposite sides of the base member defining a longitudinal path of travel. The binding system also includes an upper member having side walls. The side walls include longitudinal disposed grooves that are adapted to receive the rail members in moving engagement. The upper member is adjustably coupled adjustably coupled to the base member for selective positioning of the upper member with respect to the base member between a plurality of positions along the longitudinal path of travel. At least one actuator is further provided, which is operably coupled to the base member such that the sliding member is selectively movable between the plurality of positions along the longitudinal path of travel via actuation of the actuators by hand.

In accordance with another aspect of the present invention, the adjustable binding system includes a frame having a base member and side walls. The frame is adapted to be mounted to a surface traversing apparatus. A heel support member is provided that is rotatably coupled to the frame defining a forward inclination angle between the base member and the heel loop member. The heel loop member is selectively adjustable in a rotatable manner between a plurality of positions to vary the forward inclination angle. The binding system further includes a pair of actuators operably coupled to the binding system. The heel support member is selectively rotatable between the plurality of positions via actuation of the actuators by hand.

In accordance with another aspect of the present invention, the adjustable binding system includes a frame having a longitudinal axis. The frame is adapted to be mounted to a surface traversing apparatus. A heel support member is provided, which includes a heel loop member and a selectively movable back member. The heel loop member is pivotably coupled to the frame and has an elongate slot, and the selectively movable back member is adjustably coupled to the heel loop member and includes a plurality of slots. The binding system further includes an actuator extending through the elongate slot and having a first threaded surface adapted to be threadably engaged with a second threaded surface of a threaded securement member. The securement member is movably coupled to the back member within the plurality of slots. The actuator is threadably engaged with the securement member such that the actuator is operable by hand to fixedly secure the back member to the heel loop member, and further operable by hand to permit the back member to selectively move relative to the heel loop member.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
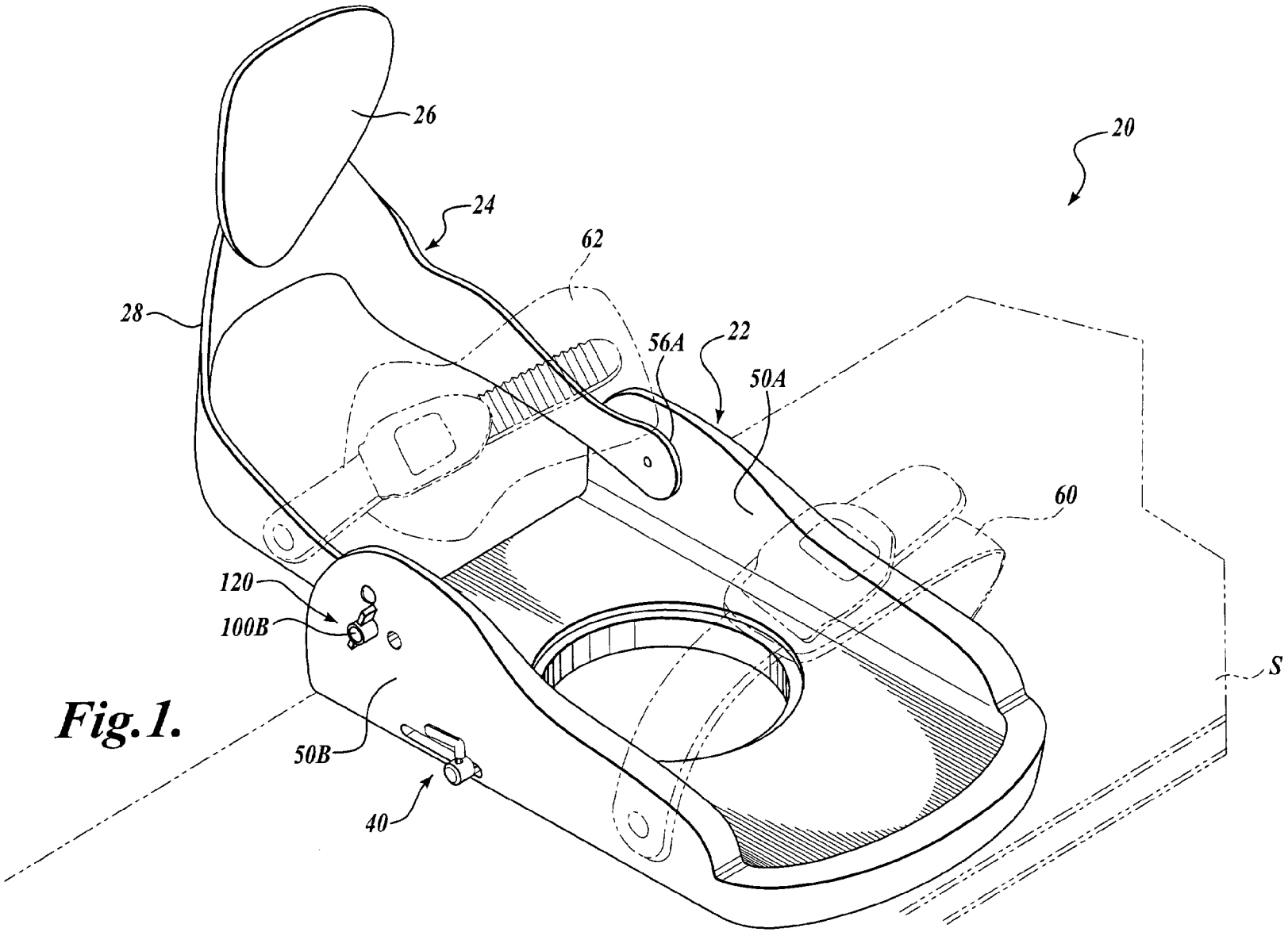
FIG. 1 is a top perspective view of an adjustable binding system constructed in accordance with aspects of the present invention.
Figure 2:
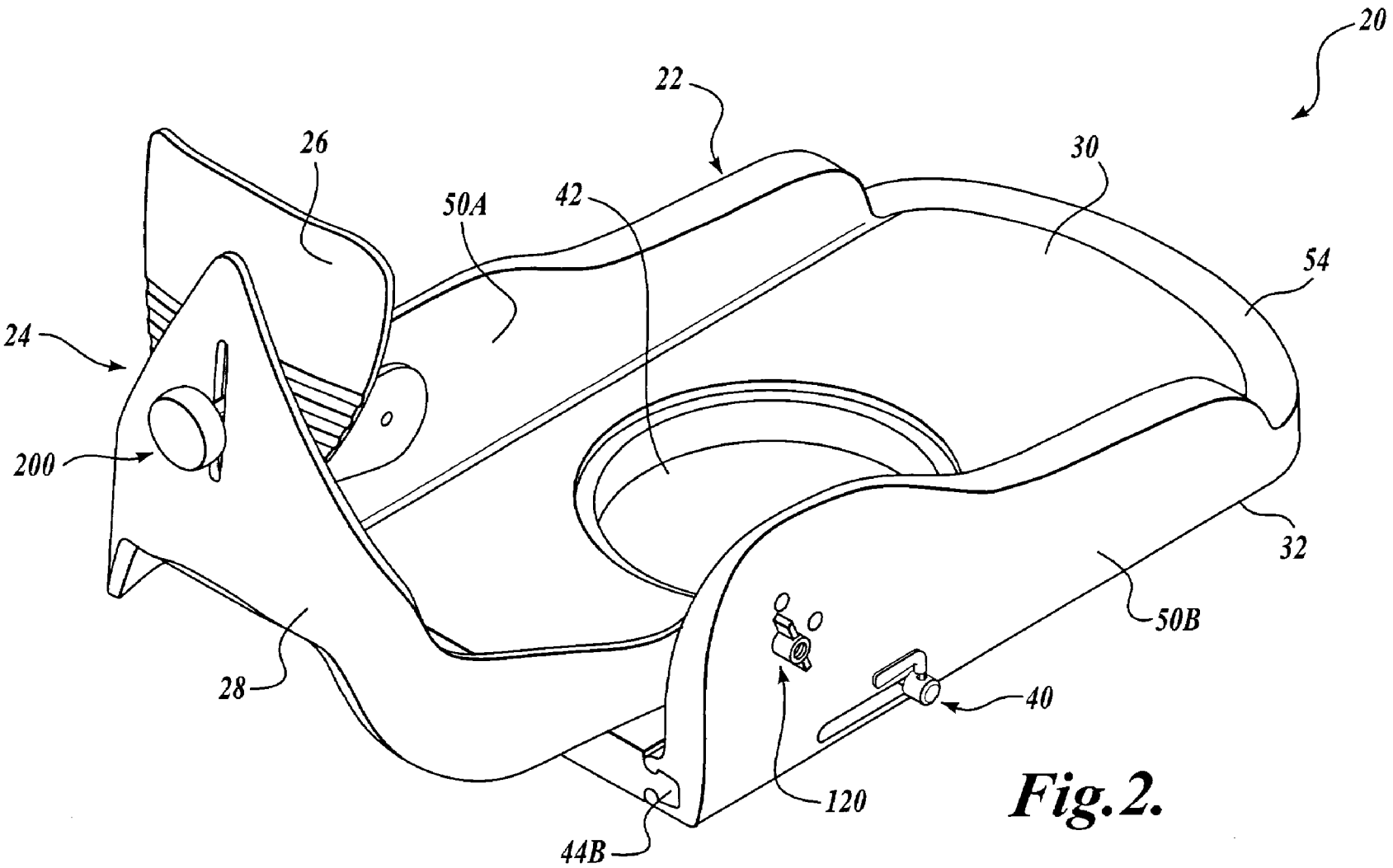
FIG. 2 is a rear perspective view of the adjustable binding system of FIG. 1.

The present invention will now be described with reference to the accompanying drawings where like numerals correspond to like elements. One suitable embodiment of an adjustable binding system 20 ("the binding system 20") constructed in accordance with aspects of the present invention is illustrated in FIGS. 1 and 2. Generally described, the binding system 20 couples boots (not shown) of the rider (not shown) to a snowboard S so that the rider's movements are transmitted to the snowboard for controlling the speed and overall direction of the snowboard. The binding system 20 is formed with multiple manual, tool-less adjustment mechanisms, which will be described in more detail below, so that the rider can receive the optimum performance from their boards. Although the binding system 20 is illustrated and described as being coupled to a snowboard S, it should be appreciated that the binding system is not intended to be so limiting. Accordingly, other surface traversing apparatus, such as snowshoes, are also within the scope of the present invention.

Referring to FIGS. 1 and 2, the binding system 20 includes a frame 22 and a highback 24 pivotally coupled to the frame 22 along a mounting axis that is transverse to the longitudinal axis of the frame 22. The highback 24 includes an upright back member or wing 26 adjustably connected to a heel loop 28. The frame 22 is adjustable via a first adjustment mechanism or length adjuster 40 to provide for a quick and easy adjustment of the toe to heel length of the frame 22 to accommodate varying sizes of boots and to provide for improved boot position with respect to the board. Additionally, the binding system is adjustable at the connection interface of the heel loop 28 and the frame 22 via a second adjustment mechanism or forward lean adjusters 120 to provide selective adjustment of an angle of forward inclination between the highback 24 and the frame 22.

The binding system 20 is further adjustable between the connection of the wing 26 and the heel loop 28 via a third adjustment mechanism or wing position adjuster 200 to provide an adjustment of the height and medial to lateral positioning of the wing 26 with respect to the heel loop 28. Each adjustment mechanism may be gripped by hand and operated without the use of tools to actuate the adjustment. Accordingly, the rider can quickly and easily adjust either the length of the frame 22, the forward lean of the highback 24, or the height or the medial to lateral positioning of the wing 26, either before the start of a run or on the slopes without removing their boots from the bindings, thereby optimizing comfort and performance of their snowboards.

Figure 3:
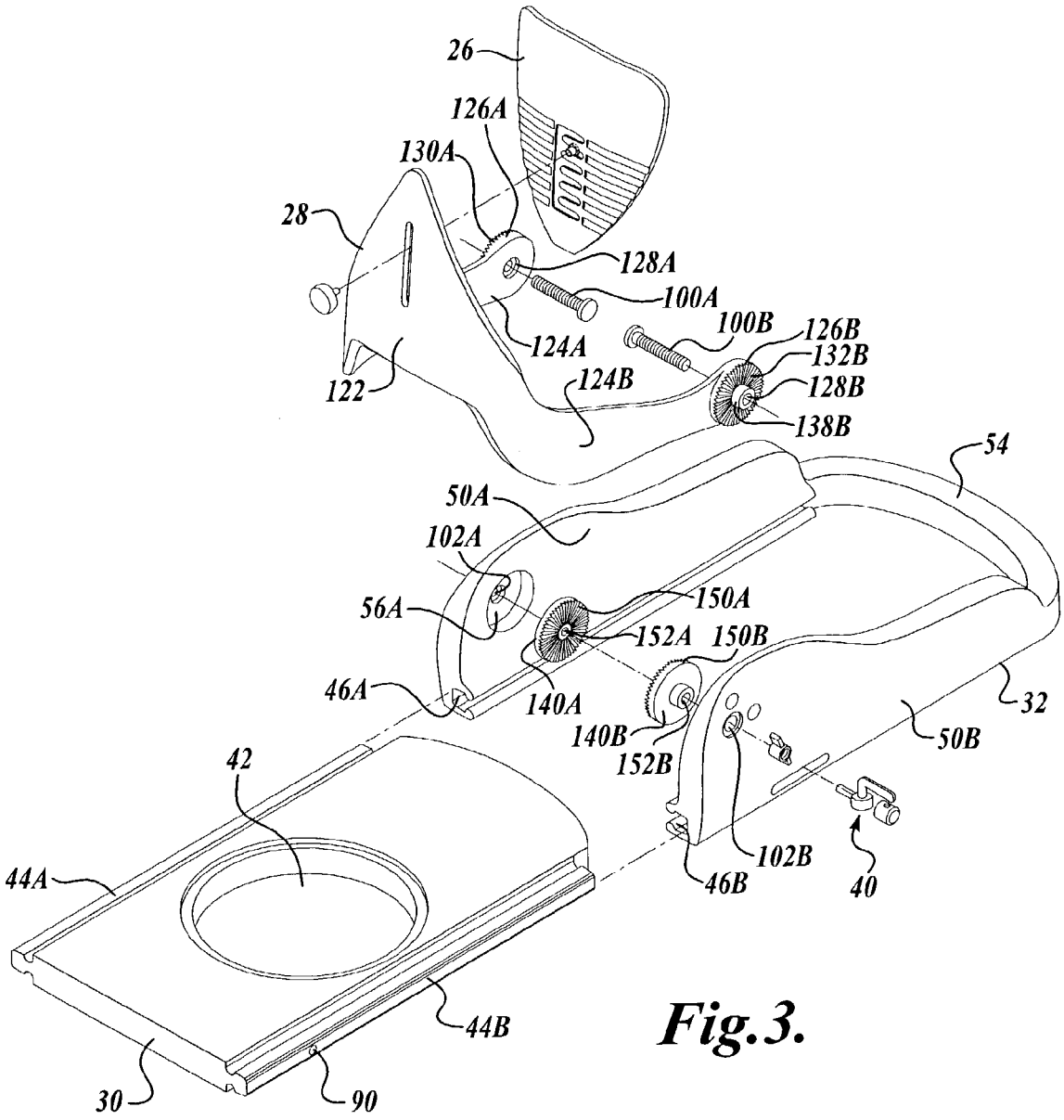
FIG. 3 is an exploded perspective view of the adjustable binding system of FIG. 2.

As best shown in FIG. 1, the frame 22 is selectively secured in a desired rotational position on the snowboard S through operation of a conventional rotodisc, which is not shown for ease of illustration but is well known in the art. Referring now to FIGS. 2 and 3, the frame 22 has a two-piece construction including a base 30 and an upper member 32 slidably mounted to the base 30. The upper member 32 may be translated with respect to the base 30 to various positions along a longitudinal path of travel that is parallel to the length of the base. The toe to heel length of the frame 22 may be selectively adjusted via a first adjustment mechanism 40, as will be described in more detail below.

The base 30 is disposed generally in a plane parallel to the upper surface of the snowboard and is generally rectangular in shape with a circular cutout forming a rotodisc opening 42 in the approximate center thereof. The base 30 further includes first and second rail members 44A and 44B disposed on opposite sides of the base 30 on which the upper member 32 is slidably mounted. The rail members 44A and 44B are preferably rounded, and extend along in the longitudinal direction of the base 30. The upper member 32 includes grooves or slots 46A and 46B of corresponding shape along the inside surface of lateral and medial side walls 50A and 50B. The grooves 46A and 46B are sized to receive the first and second rail members 44A and 44B in sliding engagement. The grooves 46A and 46B are suitably positioned within the side walls 50A and 50B so that the bottoms of the side walls 50A and 50B are flush with the bottom surface of the base 30 when assembled, and are slightly oversized so that the upper member 32 may smoothly slide along the rail members 44A and 44B of the base 30.

In the embodiment shown, the lateral and medial side walls 50A and 50B are connected together at their front ends via a middle portion 54 to form a unitary U-shaped upper member 32. As illustrated, the middle portion 54 can be the same thickness as the base 30 and is positioned adjacent to the toe end of the base 30 when attached. The middle portion 54 operates as a stop mechanism to prevent the upper member 32 from sliding rearwardly, beyond a first or non-extended position. Alternatively, the middle portion 54 may include a flange portion (not shown) integrally formed with the top surface of the middle portion that overlays the toe end of the base 30 in the non-extended position. In this embodiment, the flange portion covers the gap created when the upper member slidably adjusts in a forward direction to a second or extended position.

Referring now to FIGS. 1, 2, and 3, the lateral side wall 50A and the medial side wall 50B extend upwardly from the sides of the base 30 along the lateral and medial sides of the snowboard boot to hold the boot in position. Specifically, in the embodiment illustrated, the lateral and medial side walls 50A and 50B extend generally perpendicular to the base 30, with the toe ends of the side walls 50A and 50B being approximately uniform in height relative to each other and increasing in height toward the heel end of the base 30. The side walls 50A and 50B include annular slots 56A and 56B (56B is hidden by side all 50B in FIGS. 2 and 3) disposed at the heel end thereof. The slots 56A and 56B are positioned approximately midway along the interior surface of the side walls 50A and 50B, respectively, and are suitably dimensioned to receive a portion of the highback 24, as will be described in more detail below.

Connected proximate to the toe end of the side walls 50A and 50B is a toe strap 60. The toe strap 60 extends across and holds down the toe portion of the boot. An ankle strap 62, preferably adjustable, is connected to either the heel end of the side walls 50A and 50B, or to the heel loop 28, as illustrated in FIG. 1. Preferably, the ankle strap 62 extends across the ankle portion of the boot to hold down this portion of the rider's boot.

Referring to FIGS. 4, 5, and 6A–6B, the length adjusters 40 will now be described in greater detail. In the embodiment shown, the length adjusters 40 are suitable quick release locking mechanisms that allow the upper member 32 to be selectively translated by the rider, without tools, along the longitudinal direction of the base 30. The length adjusters 40 permit selective adjustment of the toe to heel length of the frame 22 for improved rider comfort and performance. While any one of a plurality of quick release locking mechanisms that are known in the art may be used, such as the one described in U.S. Pat. No. 5,556,222, the disclosure of which is hereby incorporated by reference, one quick release mechanism that may be utilized with the binding system 20 will now be described in detail.

Figure 4:
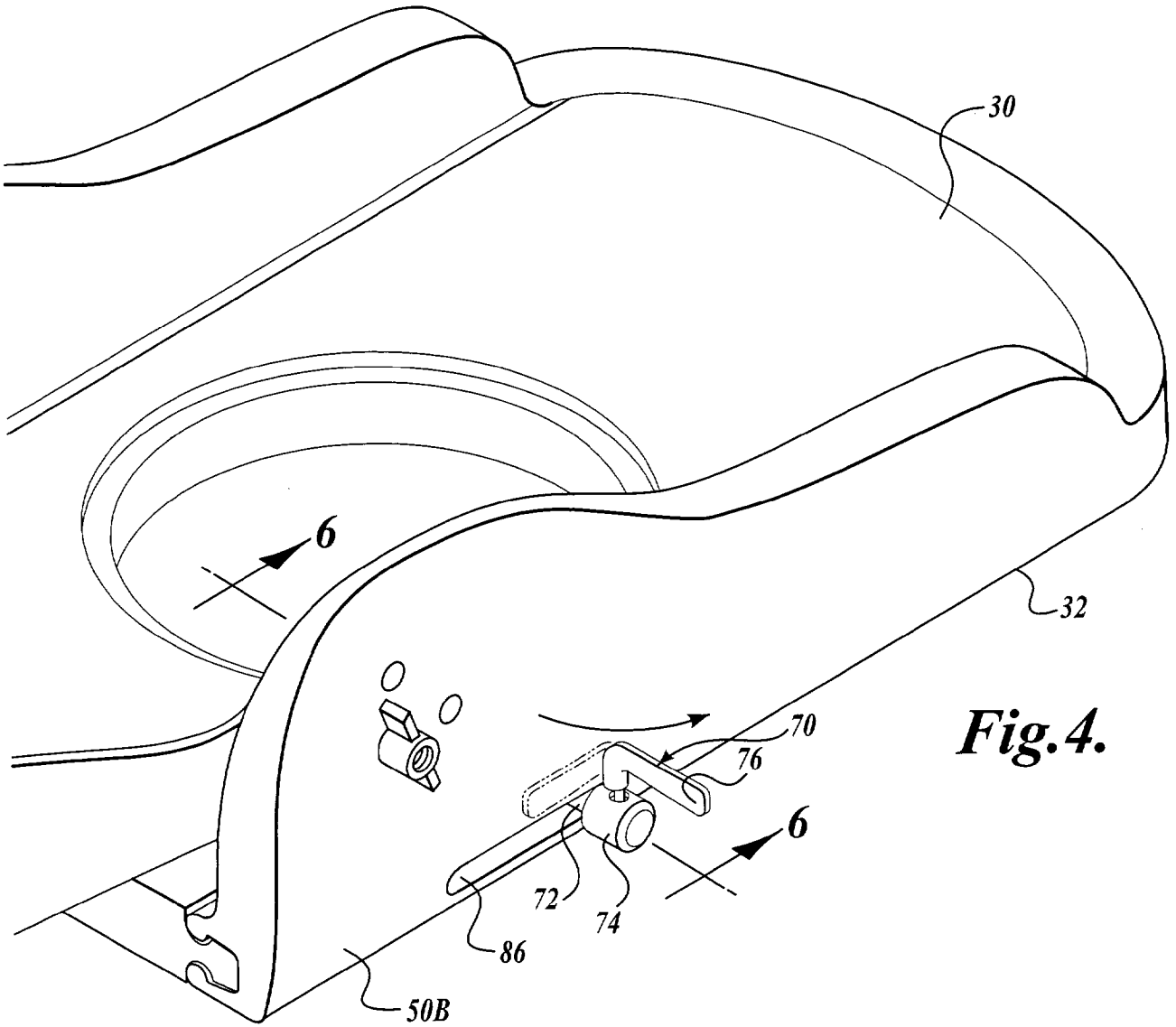
FIG. 4 illustrates a partial perspective view of the adjustable binding system of FIG. 2, whereby an upper member of the adjustable binding system is in a non-extended position.
Figure 5:
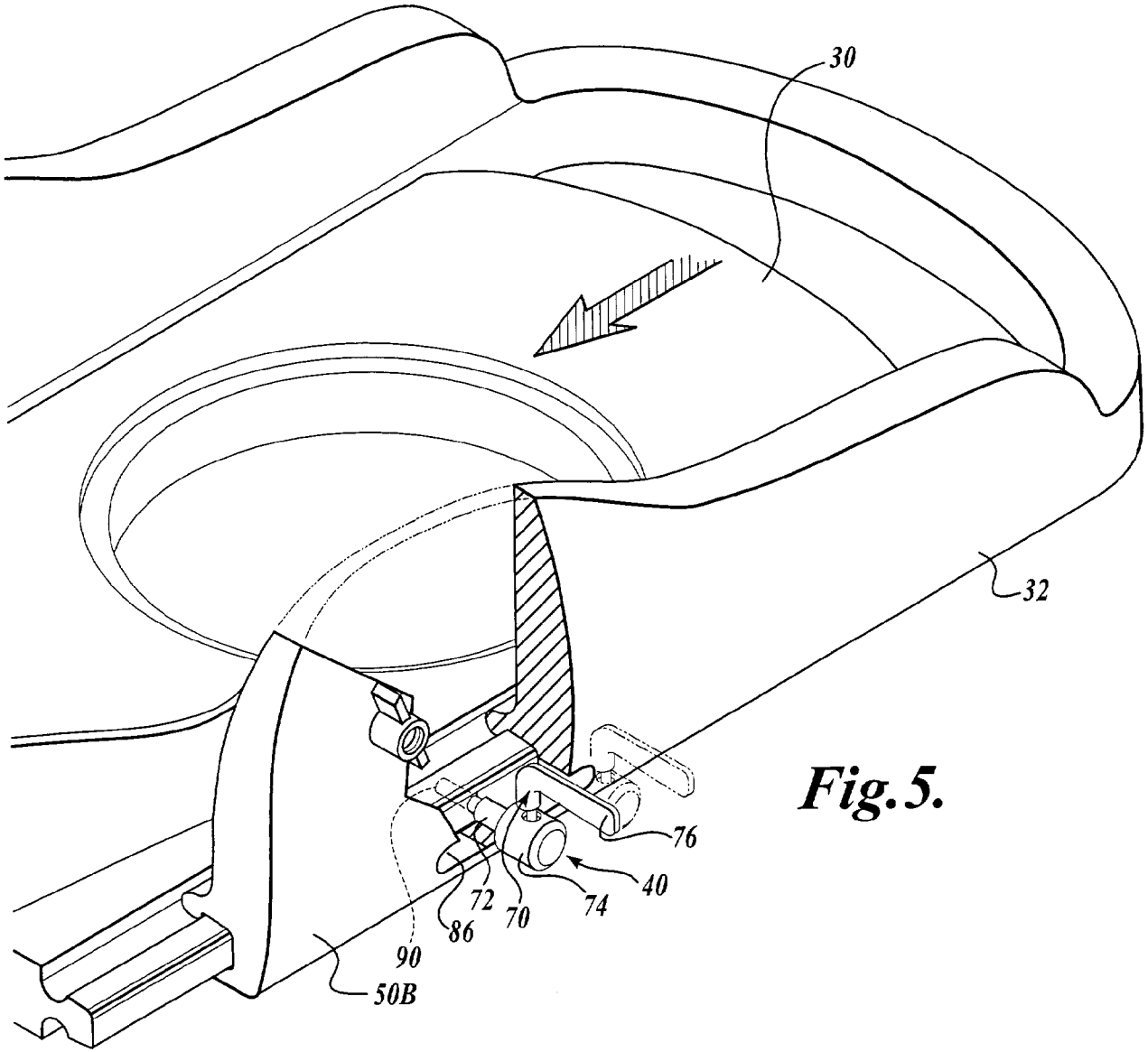
FIG. 5 is a partial cut-away perspective view of the adjustable binding system of FIG. 2, whereby the upper member of the adjustable binding system is slideable to a second position.

While only one length adjuster 40 is shown in FIGS. 4 and 5, the length adjusters 40 are positioned at the lower rearward ends of the lateral and medial side walls 50A and 50B, respectively, for selectively locking and unlocking the upper member 32 to the base 30. For clarity in the ensuing description, only the length adjuster 40 associated with the medial side wall 50B will be described. However, it will be readily evident to those skilled in the art that the length adjuster associated with the side wall 50A is substantially equivalent in structure and operation. In an alternative embodiment, only a single length adjuster 40 associated with one of the side walls of the upper member may be utilized to selectively adjust the position of the upper member 32 with respect to the base 30.

The length adjuster 40 includes an actuator 70, a shaft 72, and a cylindrical cap 74. The actuator 70 includes an actuation lever 76 and an actuation shaft 78 disposed orthogonal from the lever 76. The shaft 78 includes a central cam lobe 80 that is eccentric with the rotational axis of the shaft 78. The cam lobe 80 is rotatably mounted within a cam follower 84 secured to one end of the shaft 72. The other end of the shaft 72 is externally threaded, and extends through a longitudinal elongate slot 86 in the side wall 50B. The threaded end of the shaft 72 is received by a threaded aperture 90 (FIG. 3) located within the rail member 44B. Surrounding the cam follower 84 and the cam lobe 80 is the cylindrical shaped cap 74 having an open end and a closed end. The cap includes vertically aligned apertures 92 and 94 that are coaxial with a bore located within the cam follower 84, for rotatably mounting the ends of the shaft 78.

Figure 6A:
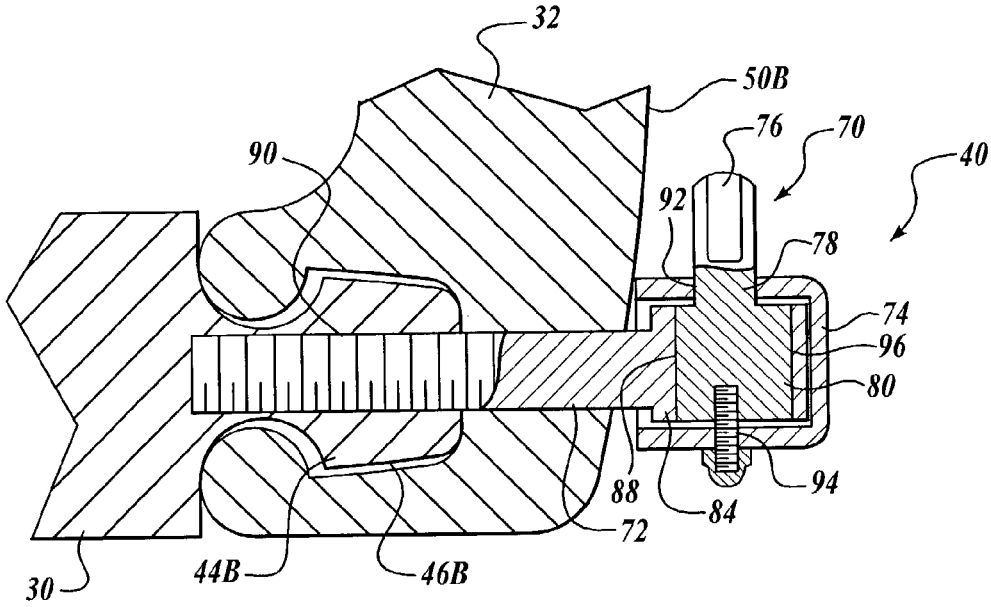
FIG. 6A is a partial cross section view of the adjustable binding system taken along lines 6—6 in FIG. 4, whereby an adjustment mechanism is in a locked position.

The operation of the length adjusters 40 will now be described with reference to FIGS. 4, 5, and 6A–6B. It will be appreciated that the operation of the other length adjuster is substantially identical to the one that will be described. FIG. 6A depicts a partial cross-sectional view of the binding system 20, wherein the length adjuster 40 is in a locked position. In the locked position, the actuation lever 76 is turned parallel with respect to the medial side wall 50B and the cylindrical cap 74 engages with the medial side wall 50B. The cam lobe 80 abuts against the outer wall 96 of the cam follower 84 and the rail member 44B is pulled tight against the inner wall of the groove 46B.

Figure 6B:
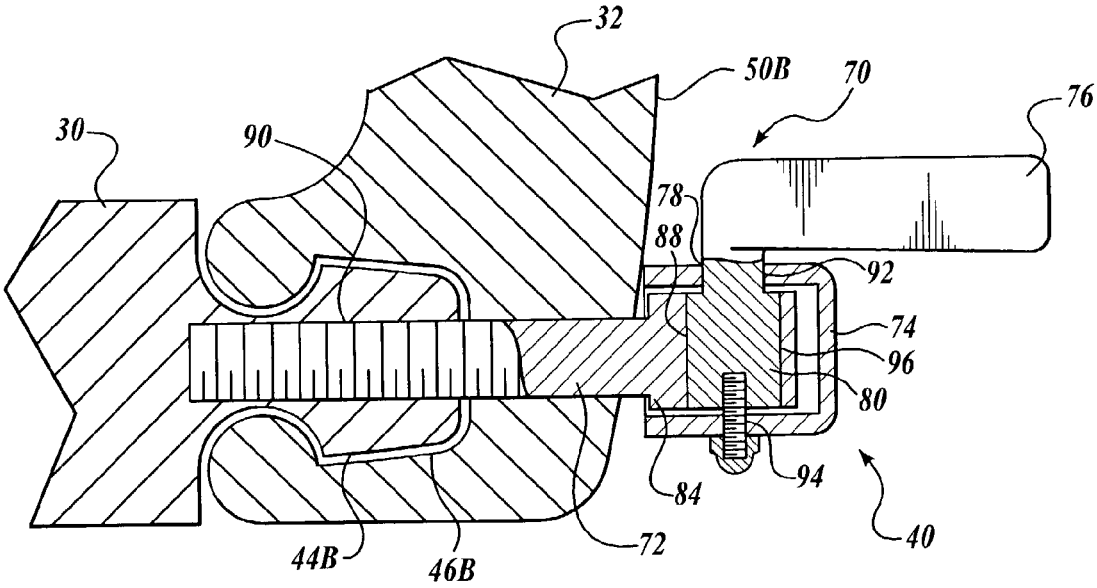
FIG. 6B is a partial cross sectional view of the adjustable binding system taken along lines 6—6 of FIG. 4, whereby the adjustment mechanism is in an unlocked position.

To selectively translate the upper member 32 to a second position, the rider rotates by hand the actuation lever 76, so that the lever 76 is substantially orthogonal to the medial side wall 52, as best shown in FIG. 4. As the lever 76 is rotated, the cam lobe 80 rotates within the cam follower 84, thereby exerting force against the inner wall 98 of the cam follower 84, which in turn, translates the shaft 72 inward. As the shaft 72 translates inwardly, the rail 44B separates from the groove 46B of the side wall 50B, as best shown in FIG. 6B. This allows the upper member 32 to slide over the base 30 along the longitudinal path of travel, as best shown in FIG. 5. As will be appreciated to those skilled in the art, the sliding member 32 has a limited longitudinal path of travel that is defined by the elongate slots 86A and 86B.

Once the upper member 32 has translated to the second, desired location, the actuation lever 76 is rotated to the position shown in FIG. 6A. As the actuation lever 76 rotates, the cam lobe 80 rotates within the cam follower 84 and exerts force against the outer wall of the cam follower 84. This translates the shaft 72 outward, causing the rail 44B to contact the groove 46B. Once the rail 44B contacts the groove 46B, the clamping force between the rail 44B and the cylindrical cap 74 fixedly locks or secures the upper member 32 to the base 30.

While the exemplary embodiment of the length adjusters 40 described above and illustrated herein has been shown to utilize a quick release locking mechanisms, it should be readily evident that other adjustment mechanisms may be utilized to provide toe to heel length adjustment without departing from the scope of the present invention. For example, instead of having a cam follower 84 at the end of the shaft 72, the end of the shaft can be externally threaded to receive a wing nut. The wing nut can be rotated to tighten against the medial side wall to generate a clamping force between the rail member and the wing nut, or can be loosened to allow the upper member to slide with respect to the base plate.

Referring now to FIGS. 1–3, and 7, the rotational coupling of the highback 24 to the rearward end of the frame 22 will now be described in greater detail. As seen best in FIG. 3, rotational coupling of the highback 24 to the frame 22 is accomplished through threaded fasteners 100A and 100B, such as bolts, screws or the like, which are received in apertures 102A and 102B centrally located in the annular slots 56A and 56B of the lateral and medial side walls 50A and 50B, respectively. The highback 24 rotates with respect to the base 30 about an axis extending through the longitudinal direction of the threaded fasteners 100A and 100B. Preferably, the axis of rotation of the highback 24 is substantially the same as the axis of rotation of the rider's ankle. The angle of forward inclination between the highback 24 and the base 30 may be selectively adjusted by forward lean adjusters 120A and 120B.

As seen best by referring to FIGS. 3, 7, and 8A–8C, the forward lean adjusters 120A and 120B are disposed at the connection interface between the highback 24 and the frame 22, and permit selective adjustment of the angle of forward inclination between the highback 24 and the base 30. As best shown in FIG. 3, the highback 24 includes a heel loop 28 in the form of a fork having a heel portion 122 and a pair of laterally-spaced arms or tines 124A and 124B extending outwardly from opposite sides of the heel portion 122. The inner surface of the heel portion 122 is preferably concave with a radius of curvature similar to the upright heel portion of the rider's boot.

The tines 124A and 124B terminate in substantially boss-like members 126A and 126B having centrally disposed bores 128A and 128B adapted to receive the shaft of the threaded fasteners 100A and 100B, respectively. The boss-like members 126A and 126B include serrated surfaces 132A and 132B on the outward-facing surface of the members 126A and 126B. The boss-like members 126A and 126B are suitably dimensioned to be received within the correspondingly shaped slots 56A and 56B, and are rotatably attached to the frame 22 by the threaded fasteners 100A and 100B. In the embodiment shown, the boss-like members 126A and 126B further include centrally located bosses 138A (not shown) and 138B, respectively, for receiving the ends of biasing members 164A and 164B, as will be described in more detail below.

Figure 8A:
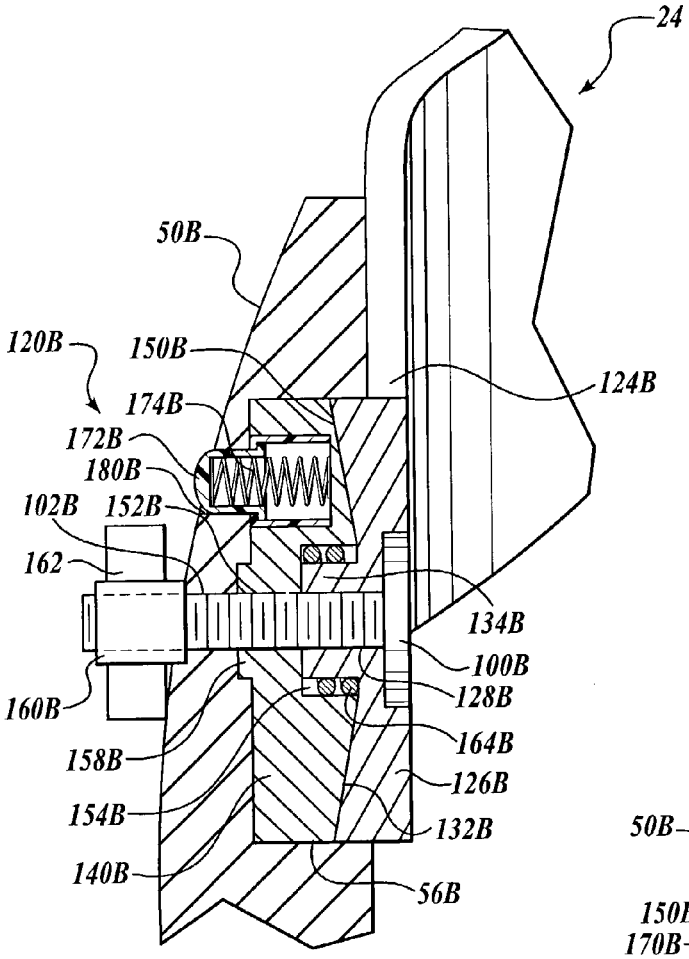
FIG. 8A is a partial cross-sectional view of a forward lean adjustment mechanism of the adjustable binding system taken along lines 8—8 in FIG. 7, illustrating the adjustment mechanism in a locked position.
Figure 8B:
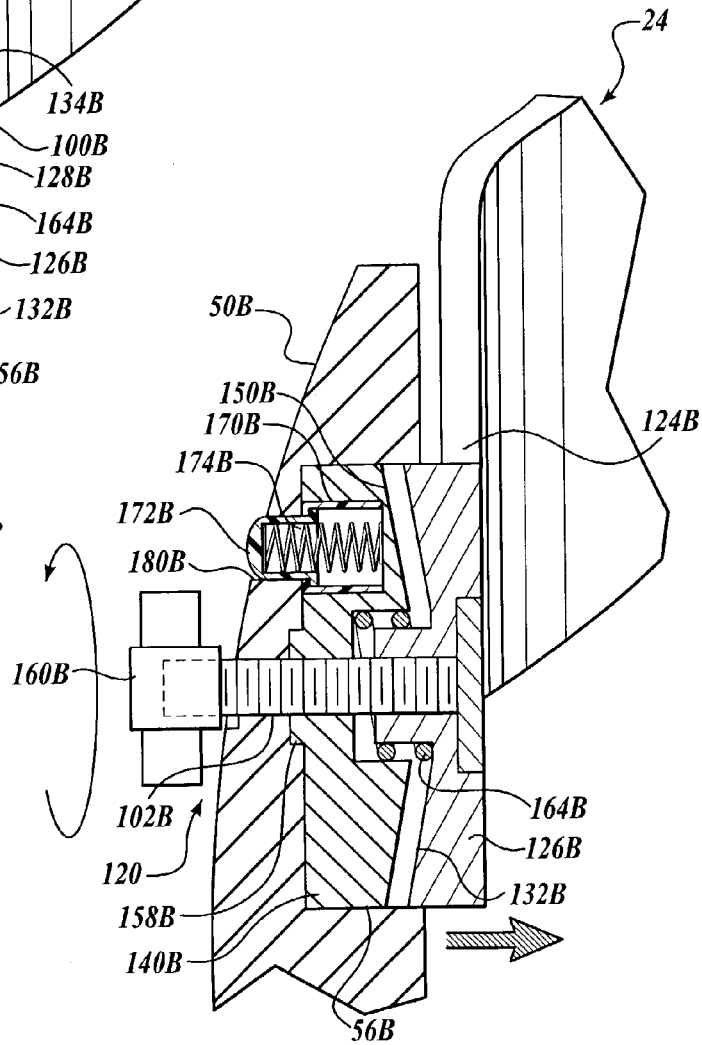
FIG. 8B is a partial cross-sectional view of a forward lean adjustment mechanism of the adjustable binding system taken along lines 8—8 in FIG. 7, illustrating the adjustment mechanism in an unlocked position.

As best shown in FIGS. 3 and 8A–8B, the forward lean adjusters 120A and 120B further include drums 140A and 140B. The drums 140A and 140B are suitably positioned within the slots 56A and 56B, respectively, between tines 124A and 124B and the inner wall of slots 56A and 56B, respectively. The drums 140A and 140B are cylindrical in shape and have substantially the same dimensions as the boss-like members 126A and 126B. The drums include serrated surfaces 150A and 150B, and centrally located bores 152A and 152B adapted to receive the threaded fasteners 100A and 100B. The drums 140A and 140B further include recesses 154A and 154B and bosses 158A and 158B, which are concentric with the bores 152A and 152B, and are located on its inward facing surfaces and outward facing surfaces, respectively. The bosses 158A and 158B are suitably dimensioned to be received within a portion of slots 56A and 56B so that the drums 140A and 140B are seated therein.

Referring now to FIGS. 8A and 8B, the forward lean adjuster 120B associated with the side wall 50B is shown in cross-section. For clarity in the ensuing description, only the forward lean adjuster 120B will be described. However, it will be readily evident to those skilled in the art that the other forward lean adjuster 120A is substantially identical in structure and operation. As best shown in FIGS. 8A and 8B, the serrated surface 132B of the boss-like member 126B engage with the serrated surface 150B of the drum 140B when assembled. The boss-like member 126B and drum 140B are held into place by the threaded fastener 100B, which passes through the respective bores of the boss-like member 126B and the drum 140B. The flat end of the threaded fastener 100B abuts against the boss-like member 126B when assembled, and may be countersunk as shown.

A threaded securement member 160B, such as a threaded nut having appendages 162 formed on the opposite sides of the securement member, is threaded on the end of threaded fastener 100B, adjacent the outside surface of side wall 50B, to pivotally attached the highback to the frame. In the embodiment shown, a biasing member, such as a spring 164B, may be captured between the boss-like member 126B and the drum 140B, and held in place by the recess 154B of drum 140B, and the boss 134B of boss-like member 126B. The spring 164B biases the boss-like member 126B and drum 140B away from each other when the securement member 160B is loosened via rotation of the appendages 162 by fingers or thumbs of the rider, as shown in FIG. 8B.

As best shown in FIG. 8B, the drum 140B further includes a slot 170B formed in its outer surface and disposed radially away from the boss 158B. The slot 170B receives a pin 172B, outwardly biased by a biasing member 174B, such as a spring or the like. The pin 172B extends transverse to the longitudinal axis of the frame 22 through aperture 180B in the side wall 50B. Aperture 180B is vertically aligned with and disposed a predetermined distance away from aperture 102B. When assembled, the pin 172B engages with the inner wall of slot 170B and the aperture 102B, thereby functioning to prohibit or lock the drum 140B against rotation within the slot 56B.

The operation of the forward lean adjusters 120A and 120B will now be described with reference to FIGS. 7 and 8A–8C. FIG. 8A depicts a partial cross-sectional view of the binding system 20, wherein the forward lean adjuster 120B is in a locked position. In the locked position, the serrated surfaces 132B of boss-like member 126B and the serrated surfaces 150B of the drum 140B are meshed together within the annular slot 56B, while the spring 164B is compressed therebetween. The threaded fastener 100B extends through the bores of the boss-like member 120B, the drum 140B, and the side wall 50B, respectively, and the securement member 160B is tightened against the outer surface of the side wall 50B. The pin 172B is biased outwardly within the aperture 180B via the biasing member 174B, and seated against the inner wall of the aperture 180B and slot 170B. The pin 172B inhibits the meshed drum 140B and the tine 124B from rotating within the slot 56B.

To selectively rotate the highback 24 to a second position thereby adjusting the forward lean, the rider rotates by hand the securement member 160B, so that the securement 160B member disengages from the outer surface of the side wall 50B, as best shown in FIG. 8B. As the securement member 160B is rotated, the serrated surface 150B of the drum 140B separate from the serrated surface 132B of the boss-like member 126B due to the biasing force of the compressed spring 164B. When the serrated surface 150B of the drum 140B separate from the serrated surface 132B of the boss-like member 126B, the highback 24 is free to rotate with respect to the drum 140B. Once the highback 24 has been rotated to the desired location, the securement member 160B is rotated to tighten against the outer surface of side wall 50B, which in turn, draws the boss-like member 126B into engagement with the drum 140B. Once the drum 140B engages with the boss-like member 126B, the clamping force between the threaded fastener 100B and the securement member 160B, along with the meshed serrated surfaces of the respective members, fixedly locks or secures the highback in place.

While the exemplary embodiment of the forward lean adjusters 120A and 120B described above and illustrated herein has been shown to utilize a threaded fastener and securement member to adjust the angle of forward inclination between the highback and the base plate, it should be readily evident that other adjustment mechanisms may be utilized without departing from the scope of the present invention.

In accordance with another aspect of the present invention, the forward lean adjusters 120A and 120B also function as a fold down mechanism. This function permits the highback 24 to rotate from a pre-selected forward lean position to a completely folded position, whereby the wing 26 engages the front portion of the base 30, as illustrated in phantom in FIG. 7. Highbacks in the completely folded position are easier to carry and can avoid damage when mounted to a vertical roof-rack type mounting system.

Figure 7:
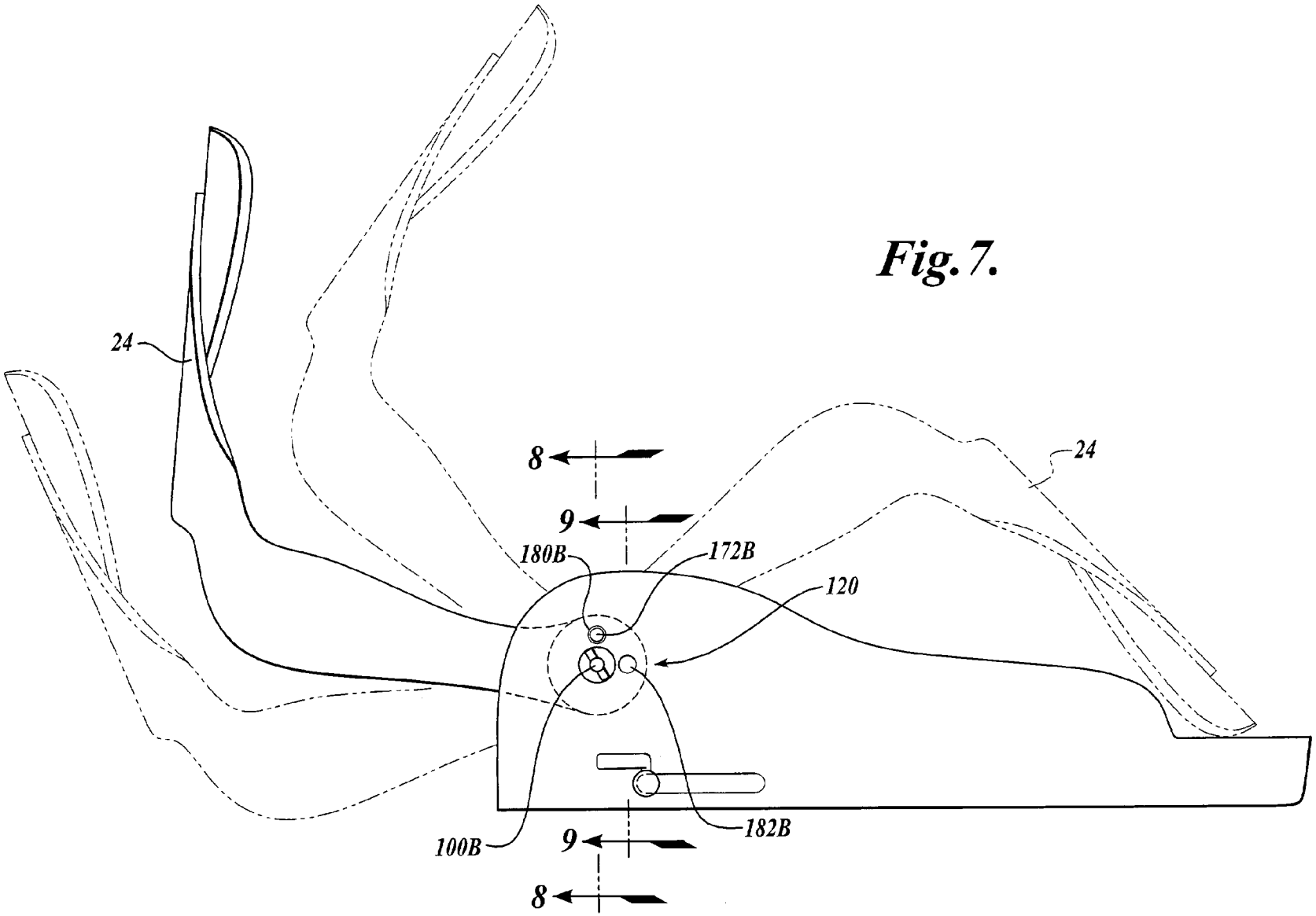
FIG. 7 is an elevational view of the adjustable binding system of FIG. 1 depicting multiple positions of a highback.
Figure 8C:
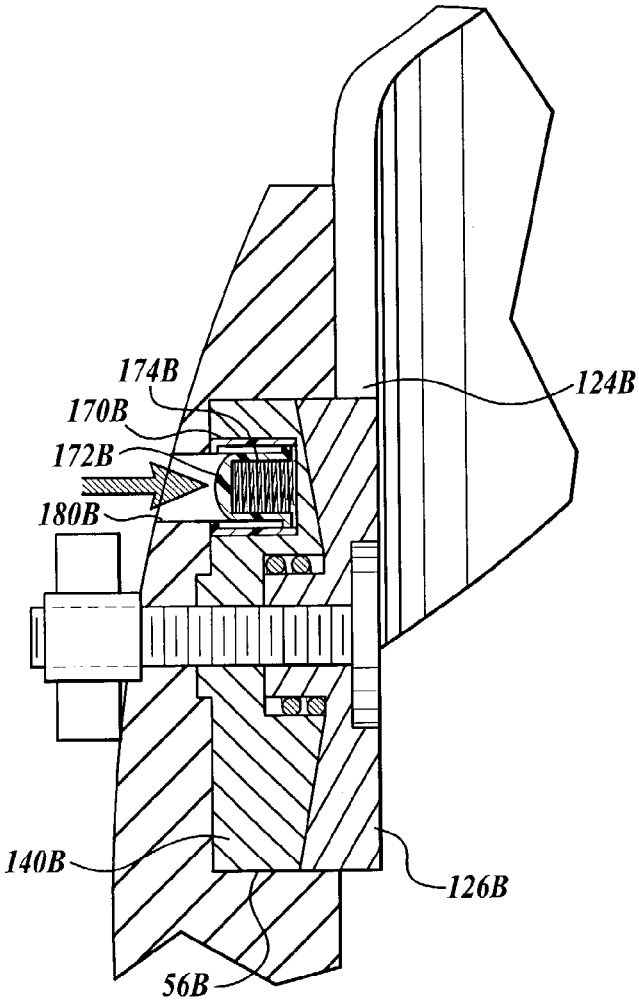
FIG. 8C is a partial cross-sectional view of a forward lean adjustment mechanism of the adjustable binding system taken along lines 8—8 in FIG. 7, wherein a pin is depressed, thereby allowing the highback to rotate to a folded position.
Figure 9:
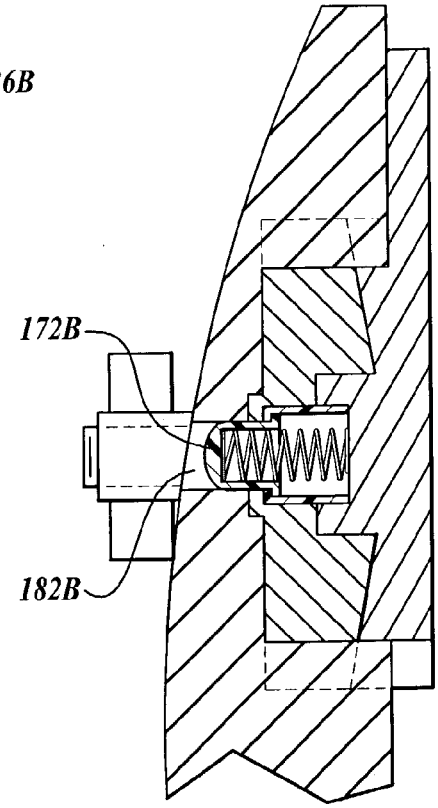
FIG. 9 is a partial cross-sectional view of the adjustable binding system taken along lines 9—9 in FIG. 7, when the highback is rotated to a folded position.

In operation, to fold the highback 24 to a completely folded position, the rider depresses the pin 172B against the biasing force of the spring 174B, as best shown in FIG. 8C. Once the pin 172B is depressed fully into the corresponding slot 170B, the pin 172B is no longer seated against the inner wall of the aperture 180B, which allows the tine 124B and drum 140B to freely rotate together within slot 56B. This, in turn, allows the highback 24 to rotate about the minor axis of the system 20 toward the top portion of the base 30, as shown in FIG. 7. The highback 24 continues to rotate until the pin 170 encounters a second slot 182B position laterally from the threaded fasteners 100B. When the pin 170B encounters the second slot 182B, the biased pin 170 translate through the aperture to lock the highback 24 at the fold down position, as best shown in FIG. 9. It will be appreciated that the slot is suitably positioned so that the highback can fold down into approximate engagement with the base plate.

While the forward lean adjusters 120A and 120 have been described above and illustrated to also function as a fold down mechanism, it will be readily evident to those skilled in the art that the drums 140A and 140B may be omitted and the bottom surface of the annular slots 56A and 56B may include serrated surfaces adapted to mesh with the tines 124A and 124B. In this embodiment, the second adjustment mechanisms or forward lean adjusters 120A and 120 are operable to selectively adjust the forward inclination angle, but will not provide the fold down functionality.

Figure 10:
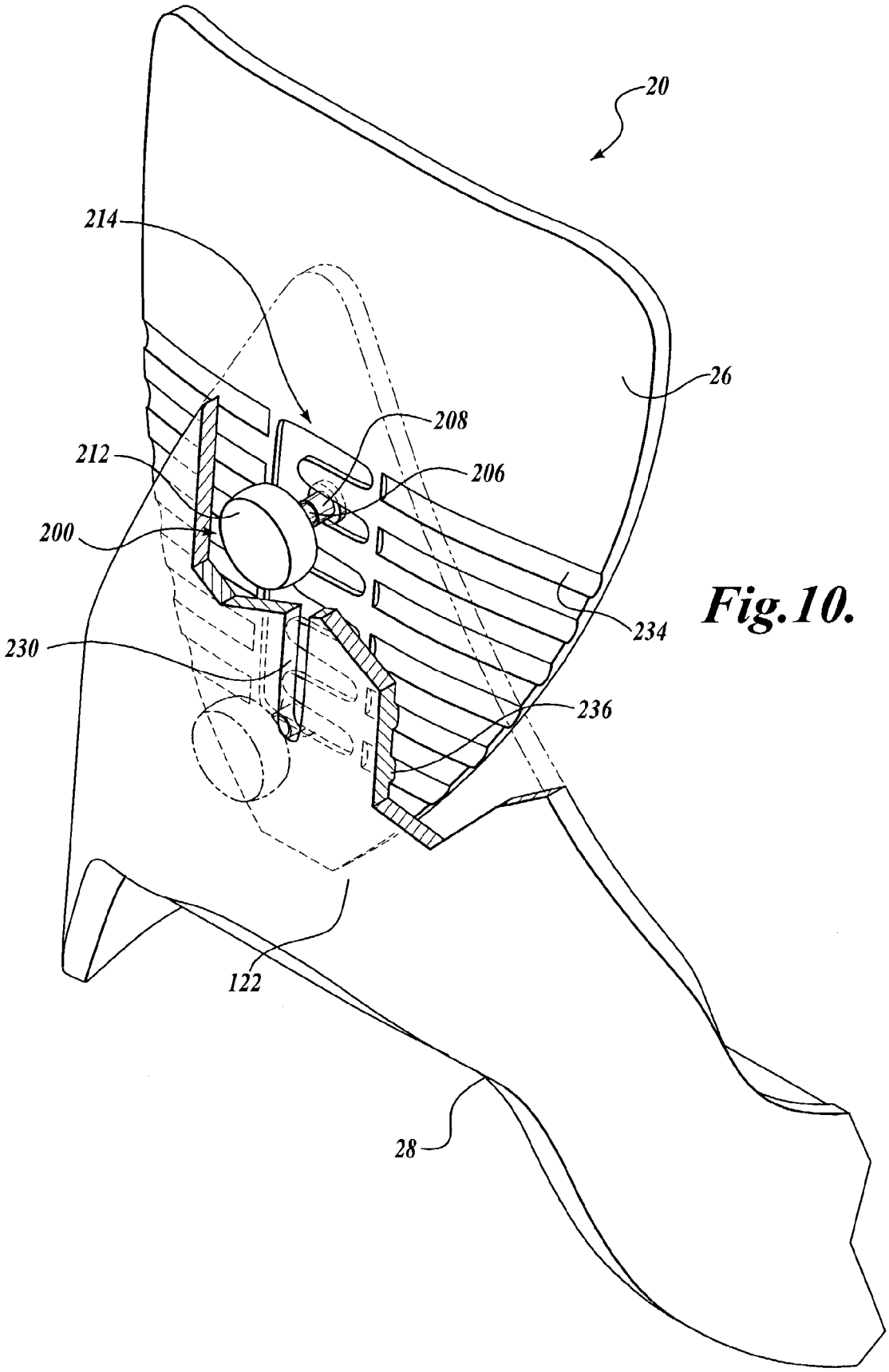
FIG. 10 is a perspective view of an adjustment mechanism disposed between a heel loop and wing of the adjustable binding system shown in FIG. 2.

Referring now to FIG. 10, the highback 24 includes a wing 26 adjustably coupled to the heel loop 28 for optimizing the comfort and performance of the binding system. The wing 26 is adapted to translate vertically to adjust the height of the highback and to translate laterally to adjust its medial to lateral positioning with respect to the heel loop 28. The position of the wing 26 with respect to the heel loop 28 is adjusted by a wing position adjuster 200 that provides incremental height and medial to lateral adjustments.

As may be seen best by referring to FIGS. 10–12B, the wing position adjuster 200 is positioned at the connection interface between the wing 26 and the heel loop 28. As best shown in FIG. 10, the wing position adjuster 200 includes an actuator in the form of a threaded fastener 206, such as a screw or the like, matable with a T-nut 208. The wing 26 is plate-like in geometry and has a radius of curvature about its major axis that corresponds to the radius of curvature of the inner surface of the heel portion 122 of the heel loop 28. In the embodiment shown, the wing 26 is substantially triangular in shape with rounded sides; however, it will be appreciated that other shapes may be used.

Figure 11:
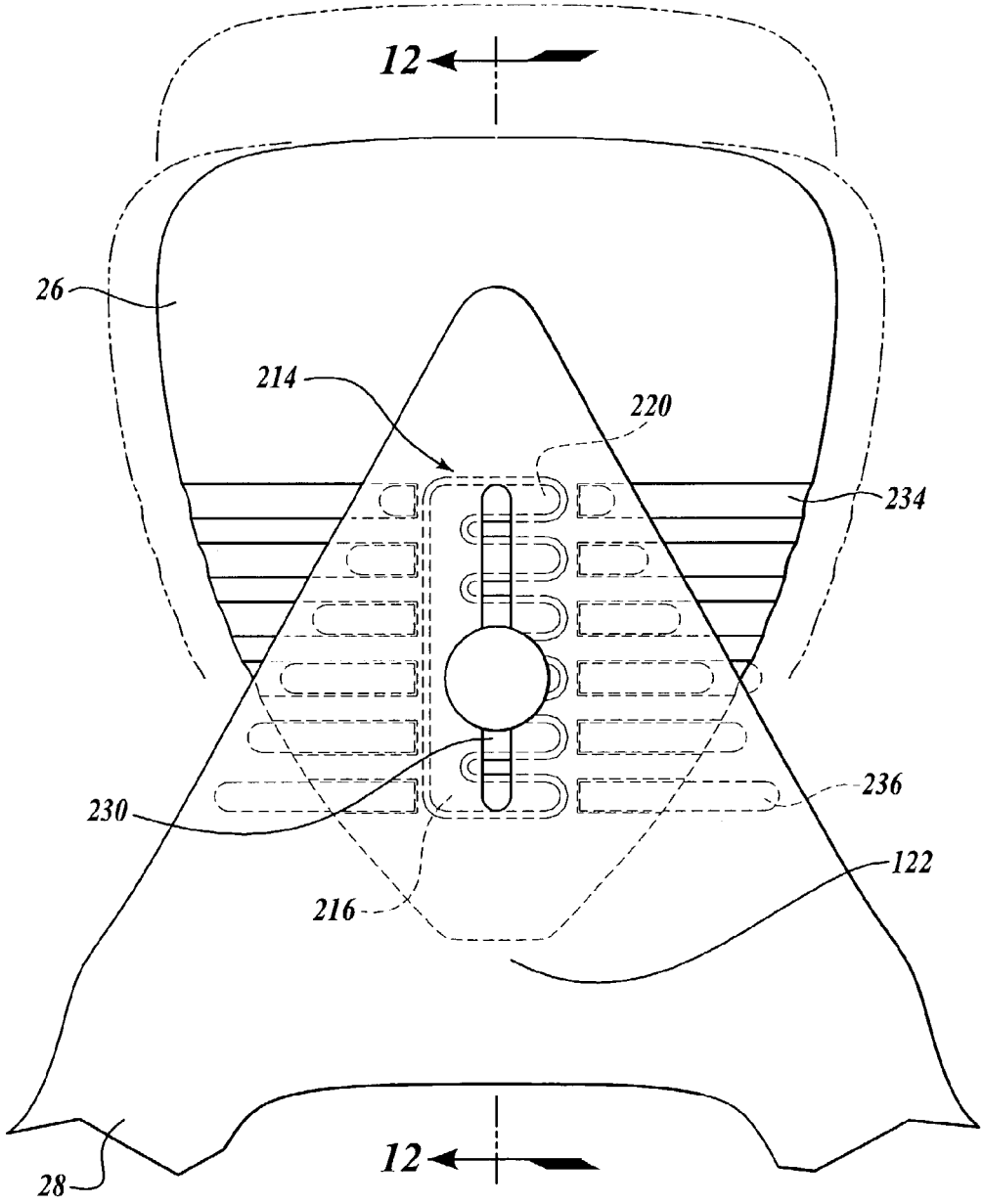
FIG. 11 is a partial rear view of the connection between the heel loop and the wing shown in FIG. 10.
Figure 12A:
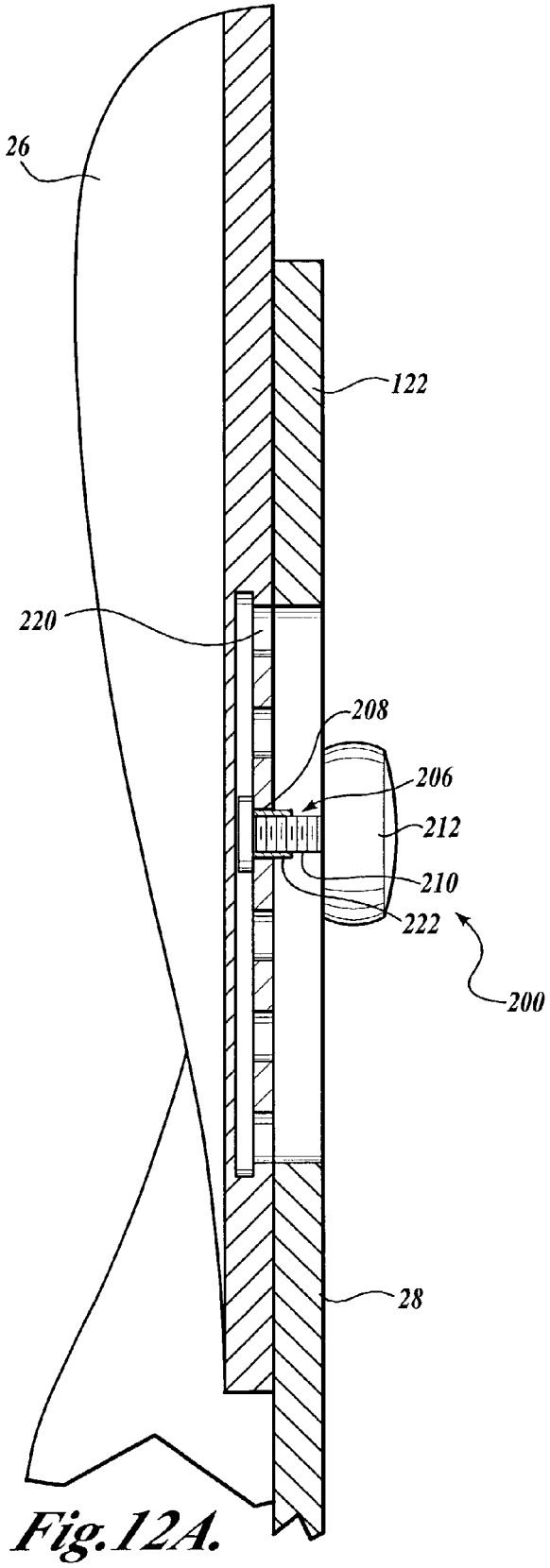
FIG. 12A is a cross-sectional view of the connection between the heel loop and wing taken along lines 12—12 in FIG. 11, showing the adjustment mechanism in a locked position.

The threaded fastener 206 includes a threaded body 210 (FIG. 12A) and a knob 212 affixed at one end. The threaded fastener 206 extends substantially parallel with the longitudinal axis of the frame 22 into a slot assembly 214. As best shown in FIG. 11, the slot assembly 214 is disposed within the outer surface of the wing 26 and includes a longitudinal slot 216 (shown in phantom) in connection with a plurality of laterally disposed slots 220. The slots 216 and 220 have T-shaped cross-sections, as best shown in FIG. 12A, to slidably retain the T-nut 208 therein. The T-nut 208 includes an internally threaded portion 222 sized to threadably receive the threaded body 210 of the fastener 206. As best shown in FIGS. 10 and 11, the heel portion 122 of the heel loop 28 includes a longitudinal slot 230, substantially orthogonal to the tines, to allow passage of the threaded fastener 206 therethrough.

Referring now to FIGS. 10 and 11, the wing 26 further includes laterally disposed grooves 234 adapted to receive corresponding lateral ribs 236 extending from a forward facing surface of the heel portion 122 of heel loop 28. The lateral ribs 236 provide a guiding mechanism as the wing 26 translates laterally with respect to the heel portion of the heel loop 28. When the threaded fastener 206 is tightened, the lateral ribs 236 and grooves 234 are drawn together to further lock the wing 26 to the heel portion of the heel loop 28 to prevent movement therebetween.

The operation of the wing position adjuster 200 will now be described with reference to FIGS. 10, 11, 12A and 12B. FIG. 12A illustrates the wing 26 in a locked position. In its locked position, the knob 212 of the threaded fastener 206 is tightened against the outside surface of the heel portion 122 of heel loop 28. The lateral ribs 236 of the heel loop 28 are seated within the laterally disposed grooves 234 of the wing 26 to prevent relative movement therebetween. The clamping force between the knob 212 and the T-nut 208, in conjunction with the engagement between the lateral ribs 236 and the grooves 234, inhibit movement of the wing 26 with respect to the heel loop 28.

Figure 12B:
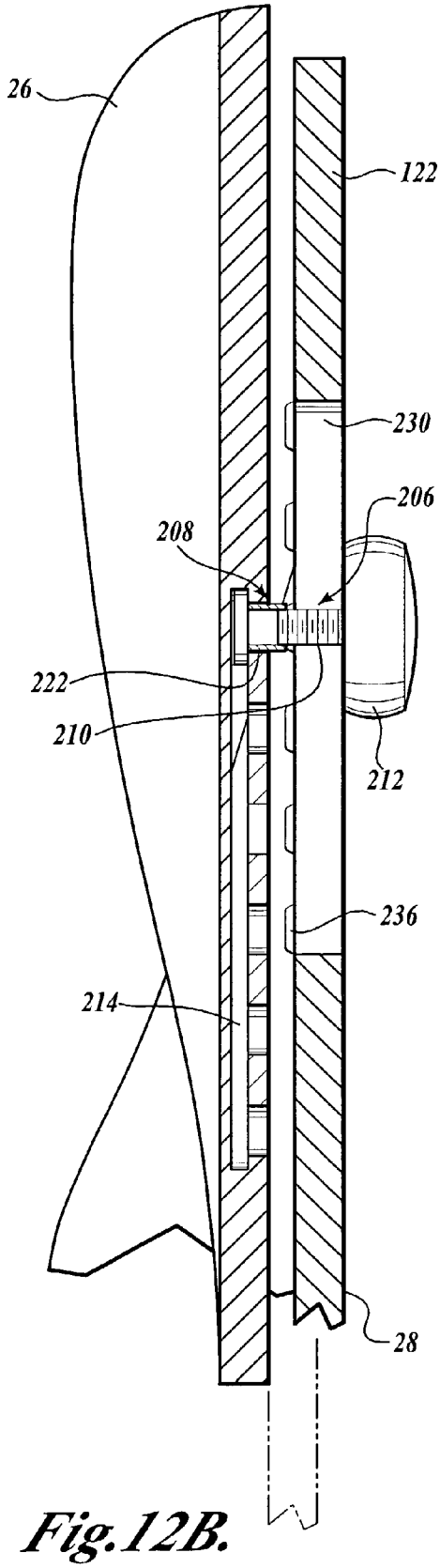
FIG. 12B illustrates a cross-sectional view of the connection between the heel loop and wing taken along lines 12—12 in FIG. 11, showing the adjustment mechanism in an unlocked position whereby the wing is separated from the heel loop.

Referring now to FIGS. 11 and 12A–12B, a rider may adjust the height and/or medial to lateral positioning of the wing 26 by loosening the threaded fastener 206 via rotation of the rotatable knob 210 by hand. As best shown in FIG. 12B, when the threaded fastener 206 is loosened by rotation of the knob 212, the forward facing surface of the heel loop 28 separates from the rear facing surface of the wing 26. As a result, the separation provided between the wing 26 and the heel loop 28 allows the lateral ribs 236 to disengage from the grooves 234 (FIG. 11). After the lateral ribs 236 disengage from the grooves 234, the wing 26 may move vertically to adjust the height or laterally to adjust the medial to lateral positioning as the threaded fastener 206 translates within slot 230 of the heel loop 28, and the T-nut 208 translates within slot assembly 214, to the desired location. Once the wing 26 is at the desired location, the knob 212 can be rotated by hand, so that the wing 26 is fixedly secured against the heel loop 28.

While the exemplary embodiment of the wing position adjuster 200 described above and illustrated herein has been shown to utilize a threaded fastener to adjust the height and medial to lateral position of the wing without tools, it should be readily evident that other adjustment mechanisms may be utilized without departing from the scope of the present invention.

The embodiments of the invention in which an exclusive property or privilege is claimed are defined as follows:

1. An adjustable binding system comprising:

a base member adapted to be mounted to a surface traversing apparatus, said base member having rail members disposed longitudinally along opposite sides of said base member defining a longitudinal path of travel;

an upper member having side walls and longitudinal grooves disposed in said side walls that are adapted to receive said rail members in moving engagement, said upper member being adjustably coupled to said base member for selective positioning of said upper member with respect to said base member between a plurality of positions along said longitudinal path of travel; and at least one actuator operably coupled to said binding system, wherein said upper member is selectively positioned between said plurality of positions along said longitudinal path of travel via actuation of said actuator by hand.

2. The binding system of claim 1, wherein said actuator is selectively positionable in an unlocked position, wherein said upper member is operable to move along said longitudinal path of travel, and selectively positionable in a locked position, wherein said sliding member is fixedly secured at a desired position along said longitudinal path of travel.

3. The binding system of claim 2, wherein said actuator is adapted to move by a user applying a force with a thumb or finger.

4. The binding system of claim 3, wherein said actuator is a rotatable member.

5. The binding system of claim 4, wherein said rotatable member is a rotatable lever.

6. The binding system of claim 2, wherein one of said side walls includes an elongate slot extending through said side wall along an axis substantially parallel to a longitudinal axis of the base member.

7. The binding system of claim 6, further comprising a shaft member secured to one of said rail members and extending substantially orthogonal to said longitudinal axis through said elongate slot, said actuator operably coupled to said shaft member such that rotation of said actuator causes outward movement of said shaft member.

8. The binding system of claim 7, wherein said outward movement of said shaft engages said rail member with said groove to inhibit relative movement between said base member and said upper member, thereby fixedly securing said upper member to said base member at said desired location.

9. The binding system of claim 7, wherein said elongate slot limits the distance of movement of said upper member along said longitudinal path of travel.

10. The binding system of claim 1, further including a heel support member pivotably coupled to said upper member, wherein said heel support member defines a forward inclination angle between said base member and a portion of said heel support member, said heel support member adapted to be selectively adjusted to vary said forward inclination angle.

11. The binding system of claim 1, wherein said heel support member includes a heel loop member and an back member movably connected to said loop member, said back member adapted to be selectively movable to adjust the position of said back member with respect to said heel loop member.

12. The binding system of claim 1, further comprising a boot retaining member connected to the upper member.

13. An adjustable binding system comprising:

a frame having a base member and side walls, said frame adapted to be mounted to a surface traversing apparatus;

a heel support member rotatably coupled to said frame thereby defining a forward inclination angle between said base member and said heel support member, said heel support member being selectively adjustable in a rotatable manner between a plurality of positions to vary said forward inclination angle; and a pair of actuators operably coupled to said binding system and positioned adjacent to or in proximity of the rotatable connection between said heel support member and said frame, wherein said heel support member is selectively rotatable between said plurality of positions via actuation of said actuators by hand.

14. The binding system of claim 13, wherein said heel support member includes a heel loop member and a back member movably coupled to said heel loop member, said back member adapted to be selectively movable to adjust the position of said back member with respect to said heel loop member.

15. The binding system of claim 13, wherein said frame includes a base member and an upper member slidably mounted to said base member, said heel support member rotatably coupled to said upper member.

16. The binding system of claim 15, wherein said base member defines a longitudinal path of travel, said upper member adapted to be selectively positioned along said longitudinal path of travel.

17. The binding system of claim 13, wherein said actuators are selectively positionable in an unlocked position, wherein said heel support member is operable to rotate so as to adjust said forward inclination angle, and selectively positionable in a locked position, wherein said heel support member is fixedly secured to said frame at a desired position.

18. The binding system of claim 17, wherein said actuator is a threaded securement member adapted to rotate via fingers or thumbs of a rider.

19. The binding system of claim 17, wherein said heel support member includes a heel portion and tines outwardly extending from opposing sides of said heel portion, the ends of said tines having a first meshable surface adapted to mesh with a second meshable surface associated with said side walls; and wherein said side walls include annular slots for receiving said ends of said tines.

20. The binding system of claim 19, wherein the inner surface of said heel portion has a radius of curvature that corresponds to a heel portion of a boot.

21. The binding system of claim 19, further comprising drums having said second meshable surface, said drums seated within said annular slots.

22. The binding system of claim 21, wherein each of said drums includes a slot, and each of said side walls includes a first aperture, said slots and said first apertures adapted to receive a pin.

23. The binding system of claim 22, further including a pin disposed within said slots and biased outwardly via a biasing member into said first apertures of said side walls, said pins operable to inhibit rotation of said drums within said annular slots.

24. The binding system of claim 23, wherein said side walls include second apertures disposed in spaced relation from said respective first apertures, said pins being depressible within said slots so as to disengage from said first apertures, which allows said drum and said tines to rotate together in meshed relationship within said annular slots until said pin extends outwardly via said biasing member into said second apertures, thereby locking said drums and said tines against rotation within said annular slots at a second position.

25. The binding system of claim 21, wherein said heel support member is rotatably coupled to said side walls by fasteners having first threaded surfaces, said threaded fasteners extending through corresponding apertures in said slots, said drums, and said ends of said tines.

26. The binding system of claim 25, wherein said actuators are securement members that define second threaded surfaces threadably engageable with said first threaded surfaces of said fasteners.

27. The binding system of claim 26, wherein manual rotation of said securement members in a first direction fixedly secures said heel support members to said frame, and wherein manual rotation of said securement members in a second direction disengages said meshable surfaces of said drums from said meshable surfaces of said tines such that said tines are free to rotate with respect to said drums.

28. The binding system of claim 27, wherein said securement members include opposing appendages to facilitate twisting with a thumb or finder of the user.

29. The binding system of claim 27, further including biasing members disposed between said drums and said tines so that said tines are biased away from said drums when said securement members are rotated in said second direction.

30. An adjustable binding system comprising:

a frame having a longitudinal axis, said frame adapted to be mounted to a surface traversing apparatus;

a heel support member including a heel loop member pivotably coupled to said frame and having an elongate slot, and a selectively movable back member adjustably coupled to said heel loop member and having a plurality of slots, said back member being at least laterally movable with respect to the longitudinal axis of the frame; and an actuator extending through said elongate slot and having a first threaded surface adapted to be threadably engaged with a second threaded surface of a threaded securement member, said securement member movably coupled to said back member within said plurality of slots;

wherein said actuator is threadably engaged with said securement member such that said actuator is operable to fixedly secure said back member to said heel loop member, and further operable to permit said back member to selectively move relative to said heel loop member, said actuator being actuated by hand.

31. The binding system of claim 30, wherein said actuator is selectively positionable in an unlocked position, wherein said back member is moveable with respect to said heel loop member, and selectively positionable in a locked position, wherein said back member is fixedly secured to said heel loop member at a desired position.

32. The binding system of claim 31, wherein said heel loop member includes a plurality of spaced-apart ribs which engage with a plurality of corresponding spaced-apart grooves in said back member when said actuator is in said locked position.

33. The binding system of claim 31, wherein said back member is fixedly secured to said heel loop member by rotation of said actuator.

34. The binding system of claim 30, wherein said frame includes a base member and an upper member movably mounted to said base member in a selectively adjustable manner, said heel support member rotatably coupled to said upper member.

35. The binding system of claim 30, wherein said heel support member defines a forward inclination angle between of portion of said frame and said heel support member, said heel support member adapted to be selectively adjusted to vary said forward inclination angle.

36. The binding system of claim 30, wherein said back member is selectively movable substantially orthogonal to the longitudinal axis of frame.

37. An adjustable binding system comprising:

a base member having a length;

an upper member adjustably coupled to said base member for selective positioning of said upper member with respect to said base member between a plurality of positions along said length of said base member;

a heel support member rotatably coupled to said upper member, thereby defining a forward inclination angle between said base member and said heel support member, said heel support member being selectively adjustable in a rotatable manner between a plurality of positions to vary said forward inclination angle;

at least one first adjustment mechanism operably coupled to the adjustable binding system to selectively adjust the position of said upper member with respect to said base member, said first adjustment mechanism including a first actuator selectively positionable in an unlocked position, wherein said upper member is movable along said length of said base member, and selectively positionable in a locked position, wherein said upper member is fixedly secured in a desired position along said length of said base member, said first actuator being activated by a thumb or finger of a rider; and a pair of second adjustment mechanisms operably coupled to the adjustable binding system to selectively adjust the forward inclination angle between said base member and said heel support member, each of said second adjustment mechanisms including a second actuator selectively positionable in an unlocked position, wherein said heel support member is operable to rotate so as to adjust said forward inclination angle, and selectively positionable in a locked position, wherein said heel support member is fixedly secured to said frame at a desired position, said second actuators being activated by a thumb or finger of a rider.

38. The binding system of claim 37, wherein said heel support member includes a heel loop member and a selectively movable back member adjustably coupled to said heel loop member.

39. The binding system of claim 37, wherein said base member has rail members disposed longitudinally along opposite sides of said base member; and said upper member including side walls having longitudinally disposed grooves adapted to receive said rail members in sliding engagement.

40. An adjustable binding system comprising:

a base member adapted to be mounted to a surface traversing apparatus and defining a longitudinal path of travel;

an upper member adjustably coupled to said base member for selective positioning of said upper member with respect to said base member between a plurality of positions along said longitudinal path of travel;

a heel support member pivotably coupled to said upper member, thereby defining a forward inclination angle between said base member and said heel support member, said heel support member including a heel loop member and a back member movably coupled to said heel loop member, said back member adapted to be selectively movable substantially orthogonal to at least one axis of said base member;

at least one first adjustment mechanism operably coupled to said adjustable binding system to selectively adjust the position of said upper member with respect to said base member, said first adjustment mechanism including a first actuator selectively positionable in an unlocked position, wherein said upper member is movable along said length of said base member, and selectively positionable in a locked position, wherein said upper member is fixedly secured in a desired position along said longitudinal path of travel, said first actuator being activated by a thumb or finger of a rider; and a second adjustment mechanism operably coupled to said adjustable binding system to selectively adjust the position of said back portion with respect to said heel loop member, said second adjustment mechanism including a second actuator selectively positionable in an unlocked position, wherein said back member is moveable with respect to said heel loop member, and selectively positionable in a locked position, wherein said back member is fixedly secured to said heel loop member at a desired position, said second actuator being actuated by a thumb or finger of a rider.

41. The binding system of claim 40, wherein said second actuator of second adjustment mechanism has a first threaded surface adapted to be threadably engaged with a second threaded surface of a threaded securement member, said securement member operably coupled to said back member; and wherein said second actuator of second adjustment mechanism is threadably engaged with said securement member such that said actuator is operable to fixedly secure said back member to said heel loop member, and further operable to permit said back member to selectively move relative to said heel loop member.

42. The binding system of claim 40, wherein said base member has rail members disposed longitudinally along opposite sides of said base member, thereby defining said longitudinal path of travel; and wherein said upper member including side walls having longitudinal grooves disposed in said side walls adapted to receive said rail members in sliding engagement.

43. An adjustable binding system comprising:

a frame including a base member adapted to be mounted to a surface traversing apparatus;

a heel support member pivotably coupled to said frame, said heel support member including a heel loop member and a selectively movable back member adjustably coupled to said heel loop member, said heel support member defining a forward inclination angle between said base member and said heel support member;

a pair of first adjustment mechanisms operably coupled to said adjustable binding system to selectively adjust the forward inclination angle between said base member and said heel support member, each of said first adjustment mechanisms including a first actuator selectively positionable in an unlocked position, wherein said heel support member is operable to rotate so as to adjust said forward inclination angle, and selectively positionable in a locked position, wherein said heel support member is fixedly secured to said frame at a desired position, said first actuator being actuated by a thumb or finger of the rider; and a second adjustment mechanism operably coupled to said binding system to selectively adjust the position of said back member with respect to said heel loop member, said second adjustment mechanism including a second actuator selectively positionable in an unlocked position, wherein said back member is moveable with respect to said heel loop member, and selectively positionable in a locked position, wherein said back member is fixedly secured to said heel loop member at a desired position, said second actuator being actuated by a thumb or finger of the rider.

44. The binding system of claim 43, wherein said second actuator of said second adjustment mechanism has a first threaded surface adapted to be threadably engaged with a second threaded surface of a threaded securement member, said securement member operably coupled to said back member; and wherein said second actuator of said second adjustment mechanism is threadably engaged with said securement member such that said second actuator of said second adjustment mechanism is operable to fixedly secure said back member to said heel loop member, and further operable to permit said back member to selectively move relative to said heel loop member.

45. An adjustable binding system comprising:

a base member adapted to be mounted to a surface traversing apparatus and defining a longitudinal path of travel;

an upper member adjustably coupled to said base member for selective positioning of said upper member with respect to said base member between a plurality of positions along said longitudinal path of travel; and a heel support member adjustably connected to said upper member for selective rotational positioning of said heel support member with respect to said base member between a plurality of positions, thereby adjusting the forward inclination angle defined between said base member and said heel support member, said heel support member including a heel loop member and a back member movably coupled to said heel loop member, said back member adapted to be selectively movable substantially orthogonal to at least one axis of said base member.

* * * * *

UNITED STATES PATENT AND TRADEMARK OFFICE

CERTIFICATE OF CORRECTION

PATENT NO. : 6,976,684 B2
APPLICATION NO. : 10/438741
DATED : December 20, 2005
INVENTOR(S) : R.G. Carrasca It is certified that error appears in the above-identified patent and that said Letters Patent is hereby corrected as shown below:

| COLUMN | LINE | ERROR |
|---|---|---|
| 13 | 27 | "drum and said tines" should read --drums and said times-- |
| 13 | 52 | "finder" should read --finger-- |
| 14 | 34 | "of portion" should read --a portion-- |
| 14 | 39 | "of frame." should read --of said frame.-- |

Signed and Sealed this

Twenty-second Day of August, 2006

JON W. DUDAS
*Director of the United States Patent and Trademark Office*